US006416365B1

(12) United States Patent
Iwahori

(10) Patent No.: US 6,416,365 B1
(45) Date of Patent: Jul. 9, 2002

(54) CONNECTOR CONTAINING FRONT HOLDER

(75) Inventor: Yoshihiro Iwahori, Shizuoka (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 09/448,497

(22) Filed: Nov. 24, 1999

(30) Foreign Application Priority Data

Nov. 25, 1998 (JP) ..... 10-333844

(51) Int. Cl.[7] ..... H01R 13/514; H01R 13/40
(52) U.S. Cl. ..... 439/752; 439/595
(58) Field of Search ..... 439/752, 595, 439/598, 599, 744

(56) References Cited

U.S. PATENT DOCUMENTS 5,256,083 A * 10/1993 Yamamoto ..... 439/595
5,529,515 A * 6/1996 Ohtaka et al. ..... 439/595
5,722,857 A * 3/1998 Saito et al. ..... 439/595

FOREIGN PATENT DOCUMENTS

DE 196 30 754 A1 2/1997
EP 0 877 447 A3 11/1998
EP 0 877 447 A2 11/1998

* cited by examiner

*Primary Examiner*—Brian Sircus
*Assistant Examiner*—Chandrika Prasad
(74) *Attorney, Agent, or Firm*—Armstrong, Westerman & Hattori, LLP

(57) ABSTRACT

A connector is provided, which includes a connector housing and a front holder, wherein the connector housing has an insertion slot for receiving the front holder therein, a terminal receiving chamber for receiving the terminal therein, and a resilient locking arm which is resiliently deformed when pushed by the terminal and is resiliently recovered when the terminal is fully inserted into the terminal receiving chamber. The resilient locking arm has a detection end which is lowered toward the insertion slot when the resilient locking arm is resiliently deformed and is lifted toward the terminal receiving chamber when the resilient locking arm is recovered. The front holder has a holder end facing the detection end, and a stopper which stops the front holder at a provisional locking position where the holder end is spaced apart from the detection end and is pushed into the insertion slot when the front holder passes through the provisional locking position. The front holder, the stopper of which is released, is shifted upward so that the holder end is movable in a direction to abut against the lowered detection end of the resilient locking arm. Thus, a secure locking of the terminal in the connector housing and an incomplete terminal insertion detector is realized, even if there are some dimensional errors for the related parts accompanying the fabrication thereof.

2 Claims, 8 Drawing Sheets

CONNECTOR CONTAINING FRONT HOLDER

BACKGROUND OF THE INVENTION (1) Field of the Invention

This invention relates to a connector for use in connecting wire harnesses and the like, in motor vehicles and, more specifically, relates to a connector containing a front holder for fastening terminals.

(2) Description of the Related Art

In FIG. 15 there is shown a longitudinal sectional view of a conventional connector containing a front holder. In FIG. 16 there is shown a primary part of the longitudinal sectional view of the conventional connector for illustrating a problem encountered with the conventional connector.

In a body $a_1$ of a connector housing a, there are provided a plurality of cylinders c each having a terminal receiving chamber b therein, a slit on an upper wall of an end portion $c_1$ of the cylinder c to form a cantilever-type resilient locking arm d, and a locking projection $d_1$ protruding toward the chamber b at a free end of the locking arm d.

As to a terminal e to be inserted into the chamber b, there is formed a locking hole $e_1$ into which the projection $d_1$ fits when the terminal e is fully inserted into the chamber b. When the terminal e is inserted into the chamber b (see FIG. 16), the terminal e pushes the projection $d_1$ to deform the locking arm d, causing a detection end $d_2$ located at the end of the locking arm d to protrude upward from the outer surface of the end portion $c_1$ of the cylinder c. When the terminal e is fully inserted into the chamber b (see FIG. 15), the projection $d_1$ fits in the hole $e_1$ so that the locking arm d is lowered at the end portion $c_1$ of the cylinder c.

A front holder f is inserted from the end of the body $a_1$ (from left in FIG. 15) and extends along the outer surface of the end portion $c_1$ of the cylinder c. When the locking arm d is lifted, the front holder f cannot be inserted into an end of the inserted position caused by abutting against the detection end $d_2$. On the other hand, when the locking arm d is lowered, the front holder f can be inserted into the end of the inserted position, namely to a final inserted position.

In operation, the front holder f is partly inserted into the cylinder c up to a provisional locking position where the front holder f does not contact with the detection end $d_2$. Then, during the insertion of the terminal e into the chamber b, the locking arm d, pushed by the terminal e, is lifted from the cylinder c. When the terminal e is fully inserted, the locking arm d is lowered, then the front holder f can be inserted up to the end of the inserted position. Upon completion of the insertion, the front holder f is locked at the final inserted position by another locking projection (not shown in the figures).

Consequently, the front holder f has one function, to detect the full insertion of the terminal e, and another function to keep the terminal e from coming off, since the front holder f restrains the locking arm d from lifting when the front holder f is inserted to the final inserted position.

In order that the front holder f detects the full insertion of the terminal e, the detection end $d_2$ of the resilient locking arm d, which is lifted due to an incomplete insertion of the terminal e, must abut against a holder end $f_1$ at the end of the front holder f (see FIG. 16).

Since the connector housing a and the front holder f are made of a synthetic resin and mold-shaped, there is some inevitable error in dimensions for these parts accompanied with the fabrication. Upon lifting of the locking arm d, lifted position g (see FIG. 16) of the detection end $d_2$ is influenced by various parameters, such as the position and dimension of the terminal receiving chamber b, the diameter of the terminal e, and the dimension of the locking arm d and the projection $d_1$ thereof.

On the other hand, internal diameter h of the front holder f has its own dimensional error accompanied with the above-mentioned fabrication. In addition, the inner diameter h must provide a clearance for allowing the front holder to be inserted with respect to the outer diameter of the end portion $c_1$ of the cylinder c (see FIG. 16).

Therefore, when the following two situations simultaneously take place, the lifted position g of the detection end $d_2$ can be lower than the position h corresponding to the lowest portion of the holder end $f_1$, as illustrated in FIG. 16. The one situation is that the lifted position g becomes significantly low within the tolerance of the connector housing a and the terminal e. The another situation is that the position h becomes significantly high within the tolerance of the holder f. In the above case, the front holder f can unfavorably be inserted to the final inserted position even if the locking arm d is in a lifted state, thereby causing a problem that the incomplete insertion of the terminal e cannot be detected.

It is therefore an object of the present invention to solve the above problem.

SUMMARY OF THE INVENTION

In order to accomplish the above object, a first aspect of the present invention is to provide a connector composed in such a manner that it comprises a connector housing and a front holder, wherein the connector housing as: an insertion slot for receiving the front holder therein; a terminal receiving chamber for receiving the terminal therein; and a resilient locking arm which is resiliently deformed when pushed by the terminal and is resiliently recovered when the terminal is fully inserted into the terminal receiving chamber, the resilient locking arm having a detection end which is lowered toward the insertion slot when the resilient locking arm is resiliently deformed and is lifted toward the terminal receiving chamber when the resilient locking arm is recovered, and the front holder having a holder end facing the detection end; and a stopper which stops the front holder at a provisional locking position where the holder end is apart from the detection end and is pushed into the insertion slot when the front holder passes through the provisional locking position, the front holder, the stopper of which is released, being shifted upward so that the holder end is movable in a direction to abut against the lowered detection end of the resilient locking arm.

A second aspect of the present invention is the connector wherein the front holder has a resilient wall which slides on the insertion slot, and said stopper is provided on a sliding surface of the resilient wall. According to this structure, when the stopper is pushed into the insertion slot, the front holder is shifted upward by a resilient force produced at the resilient wall, resulting in that the holder end of the front holder is movable in a direction to abut against the lowered detection end of the resilient locking arm. Thereby, the holder end can hit the detection end so that the incomplete insertion of the terminal can be inevitably detected.

A third aspect of the present invention is the connector wherein a stopper face to abut on a stop end of the insertion slot is formed at the insertion side of the stopper. According to this structure, the front holder is securely locked at the provisional locking position.

A fourth aspect of the present invention is the connector wherein the front holder has a resilient wall which slides in the insertion slot, said stopper being provided on a sliding surface of the resilient wall, and a stopper face to abut on a stop end of the insertion slot being formed at an insertion side of the stopper.

The connector having the above structure can realize a secure locking of the terminal in the connector housing without overlooking the incomplete terminal insertion, even if there are some dimensional errors for the parts related accompanying by the fabrication thereof.

DESCRIPTION OF THE PREFERRED EMBODIMENTS

In the following, the preferred embodiments of the present invention are explained with reference to the attached drawings.

Figure 1:
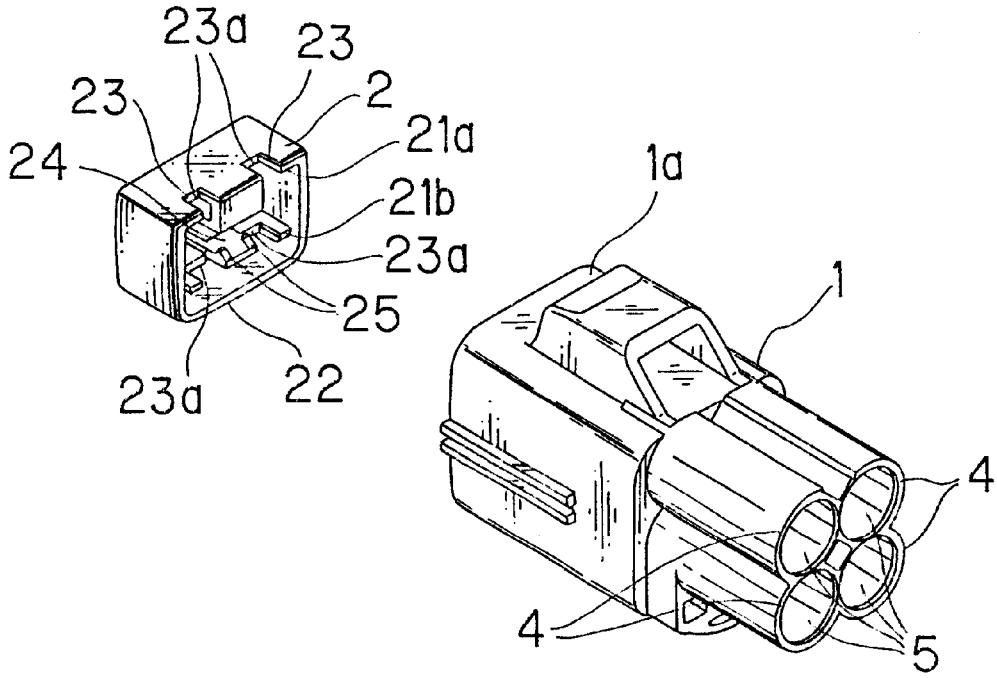
FIG. 1 is a perspective view illustrating the first example of a connector housing and a front holder according to the present invention.
Figure 2:
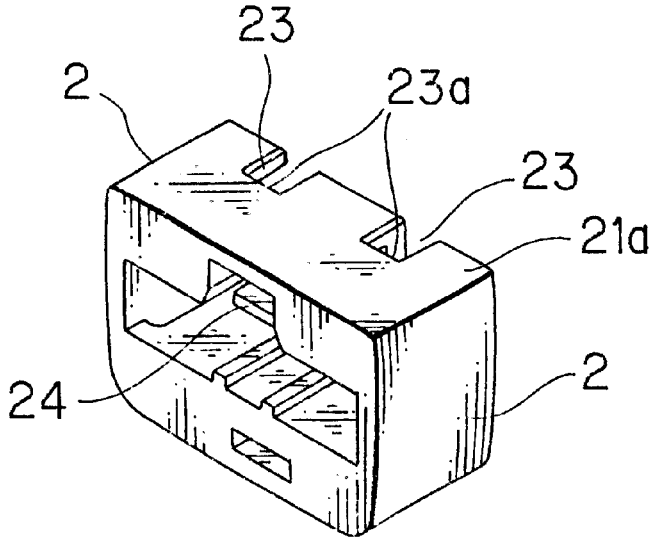
FIG. 2 is a perspective view from the rear side of the front holder of FIG. 1.

FIGS. 1 to 7 illustrate the first example of the present invention. In FIG. 1, there are shown each perspective view of a female-type connector housing 1 and a front holder 2, in FIG. 2, a perspective view from the rear side of the front holder 2, and in FIG. 3 a longitudinal sectional view illustrating a state when a male-type terminal 3 and the front holder 2 are incompletely inserted into the connector housing. 1.

The connector housing 1 has a square tube body 1*a* at the forepart and a plurality of cylindrical parts, in each of which a terminal receiving chamber 5 is provided, at the rear. (In FIG. 1, there are shown two pairs of the terminal receiving chambers 5 provided up and down in the connector housing 1.)

Figure 3:
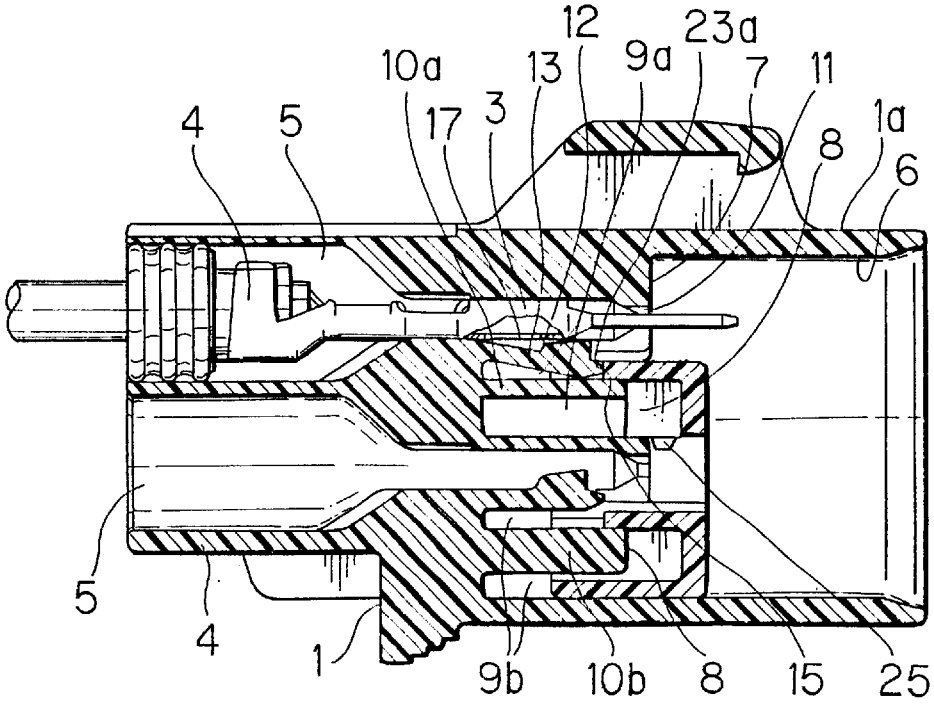
FIG. 3 is a longitudinal sectional view illustrating an incomplete inserted state of a terminal and a provisional locking position of the front holder for the first example.

As shown in FIG. 3, inside of the body 1*a,* there is formed an inner surface 6 along which a male-type counter connector housing (not shown) is fitted and a front wall surface 7 against which an end surface of the counter connector housing abuts. There are formed stop end 8 located on the left side of the wall surface 7 in FIG. 3 and insertion slots 9*a* and 9*b,* each having a pair of slots up and down, which extend from the stop end 8 toward the rear of the housing 1. Inside the insertion slots 9*a* and 9*b,* there are formed insertion guide walls 10*a* and 10*b,* respectively, each of which extends from the bottom of the insertion slot toward the front of the housing 1.

In the upper terminal receiving chamber 5 in FIG. 3, there are formed a hole 11 which opens at the front wall surface 7 and a notch 12 which extends from the chamber 5 to the insertion slot 9*a,* and a cantilever-type resilient locking arm 13 extended from the notch 12 toward the front of the housing 1. The lower terminal receiving chamber 5 in FIG. 3 has the same structure with that of the upper one.

Figure 6:
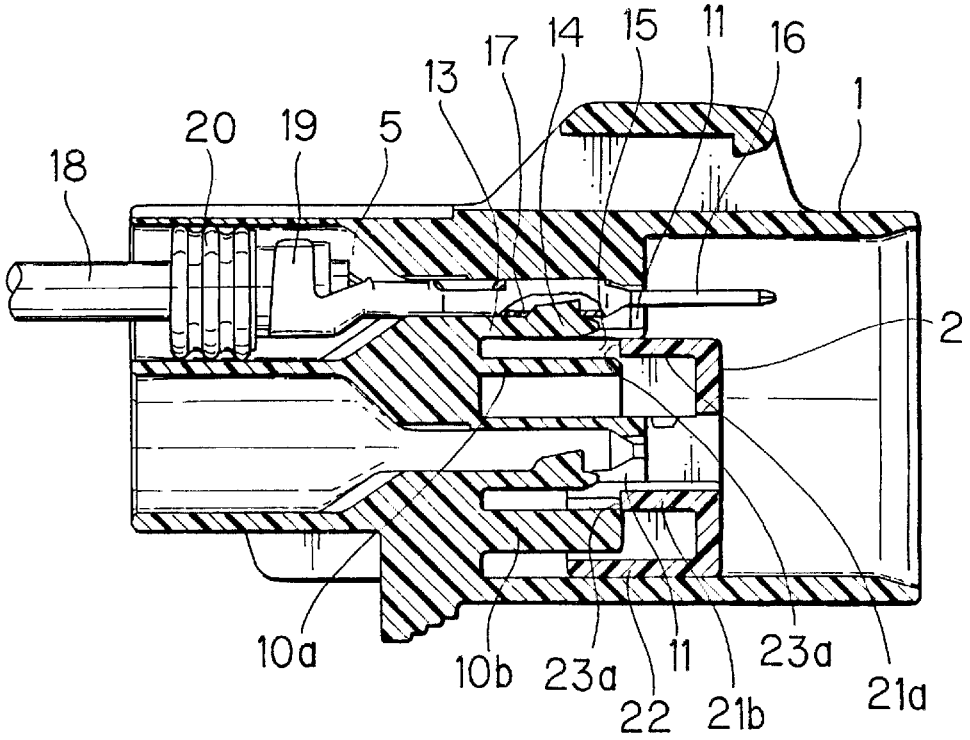
FIG. 6 is a longitudinal sectional view illustrating a fully inserted state of the terminal for the first example.
Figure 7:
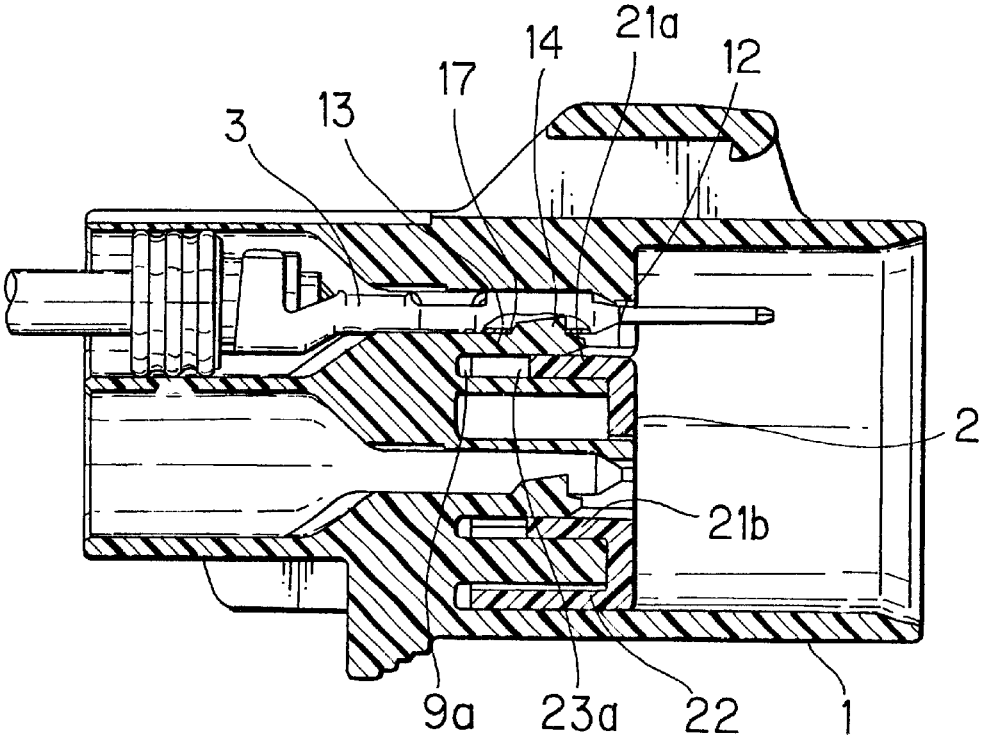
FIG. 7 is a longitudinal sectional view illustrating a state when the front holder is fully inserted in succession from the state shown in FIG. 6.

As shown in FIG. 6, a locking projection 14 is formed on the upper surface of the locking arm 13 and a detection end 15 is formed at the end of the locking arm 13.

As for the terminal 3 to be inserted into the chamber 5, at the end there is formed a tube-shaped electrically connecting portion 16 which protrudes through the hole 11 to fit in a counter terminal (not shown). At the intermediate portion of the body of the male terminal 3 there is formed a locking hole 17 in which the locking projection 14 fits when the terminal 3 is fully inserted, and at the rear end of the terminal there is formed an electrically connecting portion 19 which connects an electric wire 18. A seal 20 is also provided for the terminal 3 to seal an opening between the wire 18 and the terminal receiving chamber 5 thereby to ensure waterproofing of the chamber (see FIG. 6).

As shown in FIG. 1, in the front holder 2, there are formed insertion walls 21*a* and 21*b,* each of which protrudes frontward at the upper end and at the intermediate portion of the holder 2, respectively, and there is formed a lower wall 22 at the lower end of the holder 2. The insertion wall 21*a* at the upper end is inserted into the insertion slot 9*a* to slide on the upper surface of the insertion guide wall 10*a*. The insertion wall 21*b* at the intermediate portion is inserted into the insertion slot 9*b* to slide on the upper surface of the insertion guide wall 10*b*.

Two hollow portions of notches 23 are formed at the end surface of the insertion walls 21*a* and 21*b*. The bottom surface of each hollow portion of a notch 23 is a holder end 23*a* which is adapted to abut against the detection end 15. The detection end 15 is lowered toward the insertion slot 9*a* when the locking arm 13 is resiliently deformed (see FIGS. 1, 2, 3 and 6).

Figure 4:
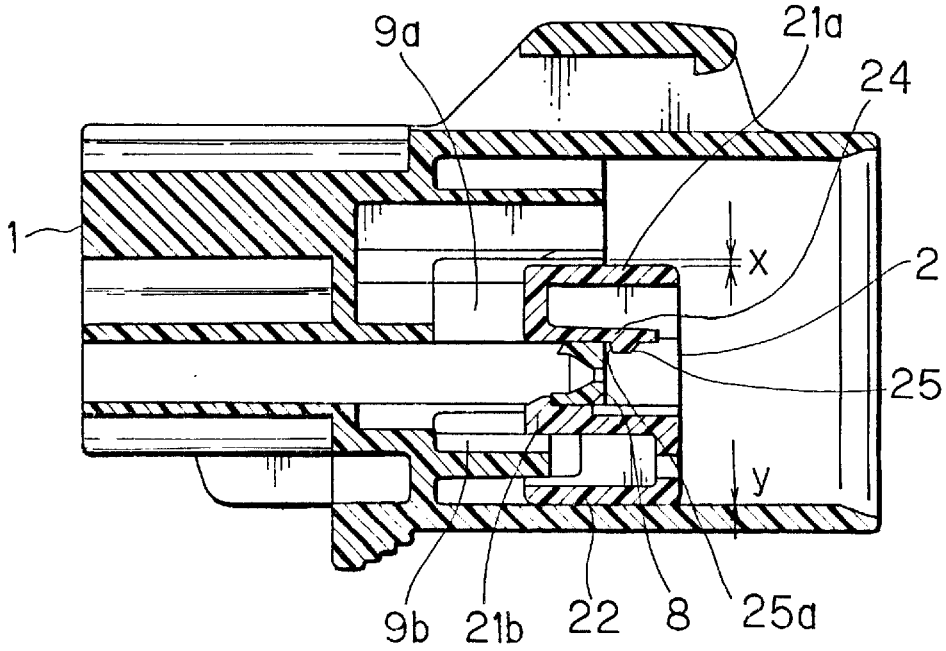
FIG. 4 is a longitudinal sectional view illustrating an opening between the front holder at the provisional locking position and an insertion slot, and a stopper of the front holder for the first example.
Figure 5:
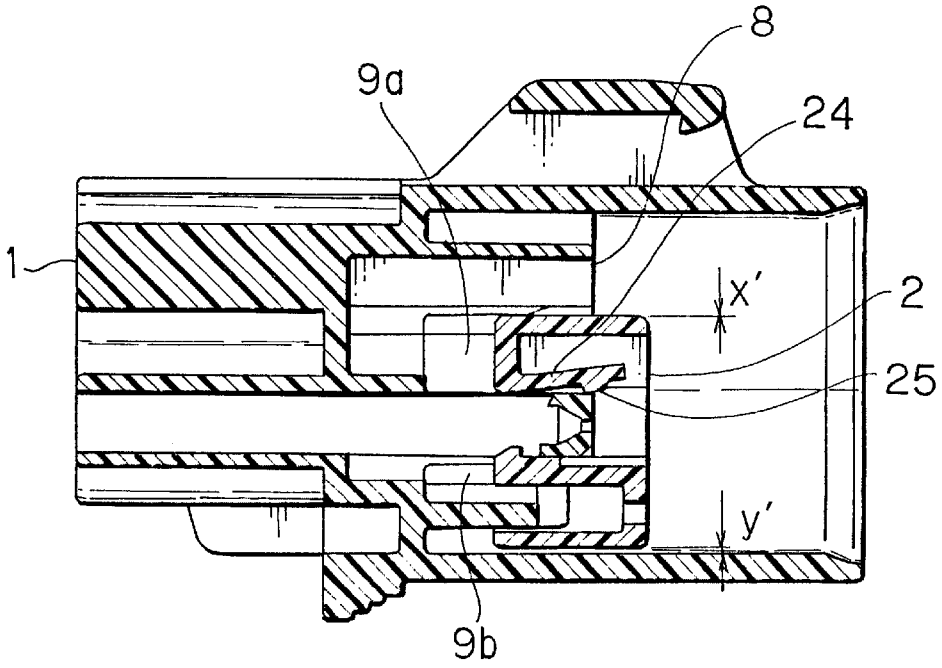
FIG. 5 is a longitudinal sectional view illustrating a change in an opening shown in FIG. 4 when the stopper is moved into the insertion slot.

As shown in FIG. 4, in the front holder 2, there is formed a resilient wall 24 slidable on the lower surface of the insertion slot 9*a* and a stopper 25 is formed on the sliding surface of the resilient wall 24. The stopper 25 has a stopper face 25*a* which stops the front holder 2 at a provisional locking position when the stopper face 25*a* abuts against the stop end 8.

Now, the function of the above-composed connector housing 1 and the front holder 2 is explained with referring to FIGS. 3 to 7.

As shown in FIG. 3, when the front holder 2 is inserted into the insertion slots 9*a* and 9*b,* the front holder 2 stops at the provisional locking position where the stopper 25 abuts against the stop end 8. In the provisional locking state, the holder end 23*a* of the front holder 2 is located at the position where it does not hit against the detection end 15 of the locking art 13.

When the terminal 3 is inserted into the terminal receiving chamber 5, the terminal 3 pushes the locking projection 14 to resiliently depress the locking arm 13, causing the detection end 15 to be lowered toward the insertion slot 9*a*. When the front holder 2 is at the provisional locking position, an opening of size x is formed between the upper insertion wall 21*a* and the insertion slot 9*a,* and an opening of size y is formed between the lower wall 22 and the insertion slot 9*b* (see FIG. 4).

After the complete insertion of the terminal 3, when the front holder 2 is pushed toward the inserting direction from the provisional locking position, the resilient wall 24 is deformed to allow the stopper 25 to run onto the lower surface of the insertion slot 9*a,* causing the front holder 2 to lift up due to the resilient force of the resilient wall 24. Accordingly, the opening size x' between the upper insertion wall 21*a* and the insertion slot 9*a* is reduced to be almost zero and the opening size y' between the lower wall 22 and the insertion slot 9*b* is enlarged (see FIG. 5), that is, the holder end 23*a* of the front holder 2 is significantly lifted up.

On the other hand, when the terminal 3 is not fully inserted so that the detection end 15 is lowered toward the insertion slot 9*a* (see FIG. 3), the holder end 23*a* inevitably hits the detection end 15 upon the insertion of the front holder 2, resulting in that the incomplete insertion of the terminal 3 is assuredly detected, even if there are some dimensional errors for the related parts accompanying the fabication thereof.

When the terminal 3 is fully inserted, the locking hole 17 of the terminal 3 fits with the locking projection 14 of the resilient locking arm 13, that is, the locking arm 13 resiliently recovers to its original shape (see FIG. 6) from its deformed shape (see FIG. 3). Consequently, the front holder 2 can be fully inserted into the insertion slot 9*a* by pushing from the lifted position as described above (see FIG. 7).

The fully inserted holder 2 prevents the locking arm 13 from being deformed downward so that the fitting between the locking hole 17 of the terminal 3 and the locking projection 14 of the resilient locking arm 13 is maintained to prevent the terminal 3 from coming off.

FIGS. 8 to 14 illustrate the second example of the present invention concerned with a male-type connector housing 26 having a front holder 27. This connector housing is different in shape from that of the first example, nevertheless the function is the same. Consequently, each part having the same function with that of the corresponding part in the first example is given the same number so that the detailed description of such parts is omitted in the following.

Figure 8:
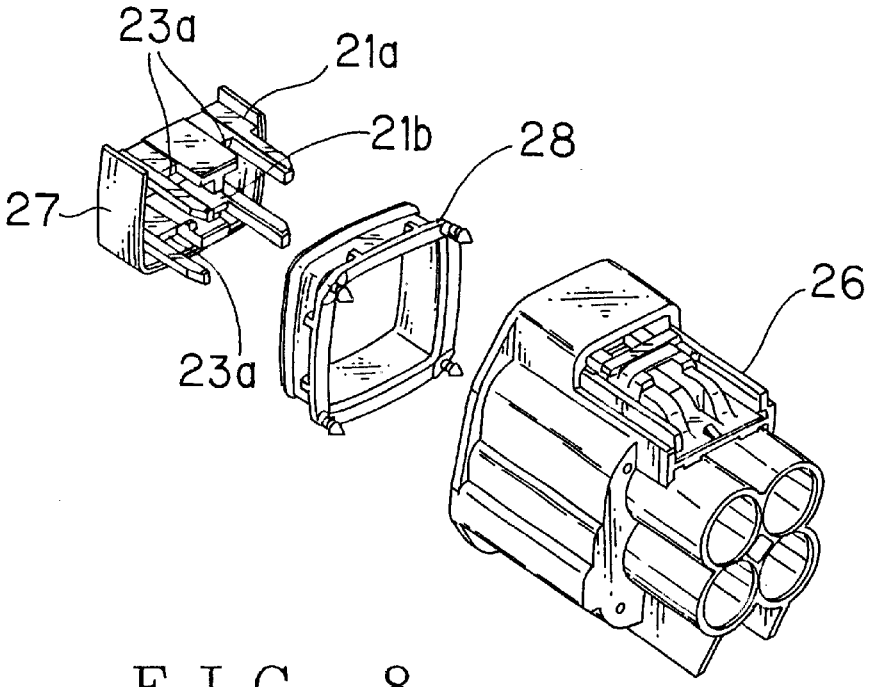
FIG. 8 is a perspective view illustrating the second example of a connector housing and a front holder according to the present invention.
Figure 9:
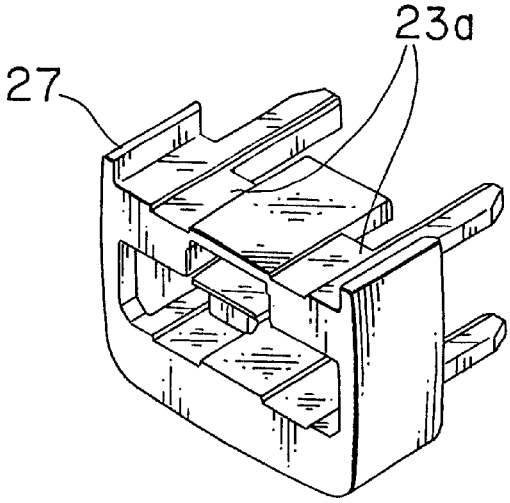
FIG. 9 is a perspective view from the rear side of the front holder of FIG. 8.
Figure 10:
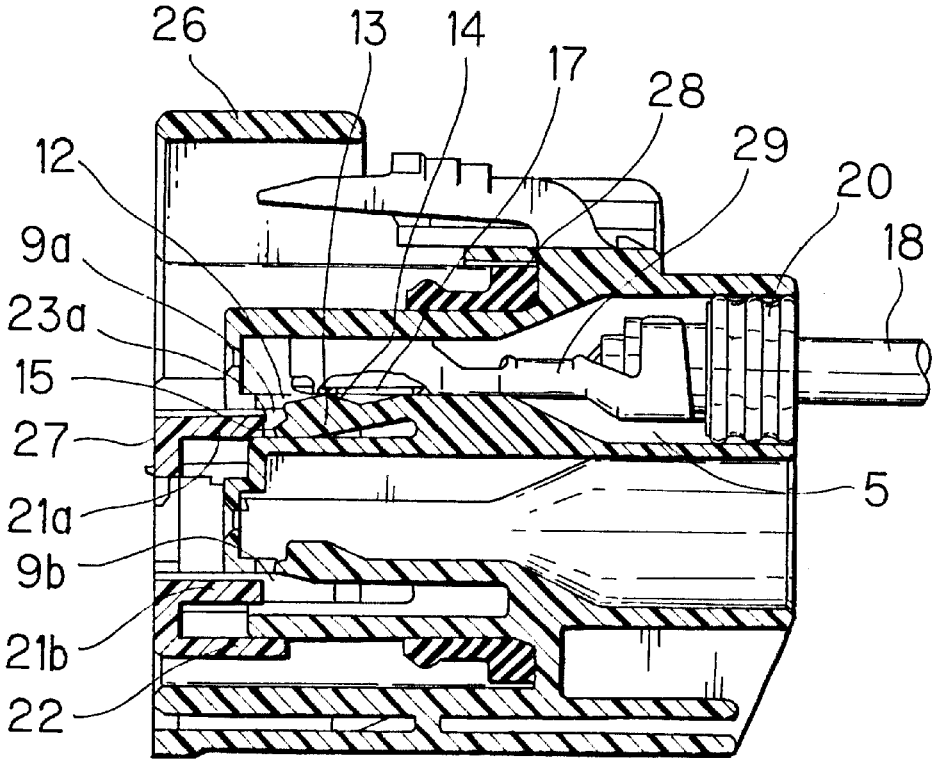
FIG. 10 is a longitudinal sectional view illustrating an incompletely inserted state of a terminal and a provisional locking position of the front holder for the second example.
Figure 11:
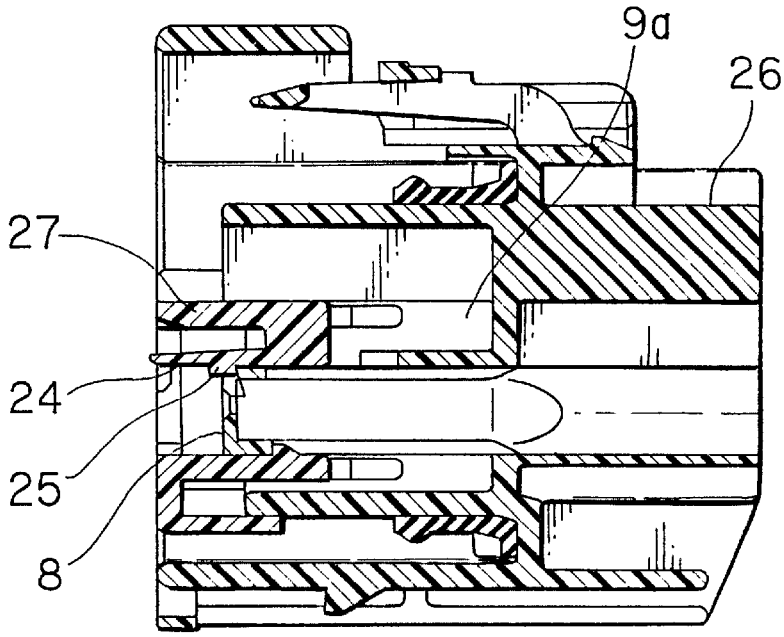
FIG. 11 is a longitudinal sectional view illustrating a stopper in the provisional locking state for the second example.
Figure 12:
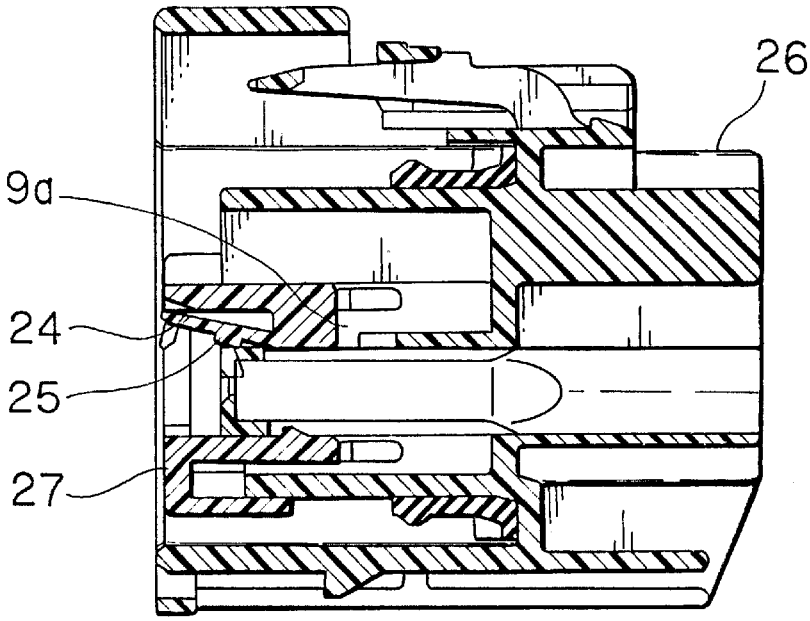
FIG. 12 is a longitudinal sectional view illustrating a stopper moved into an insertion slot after escaped from the provisional locking state.
Figure 13:
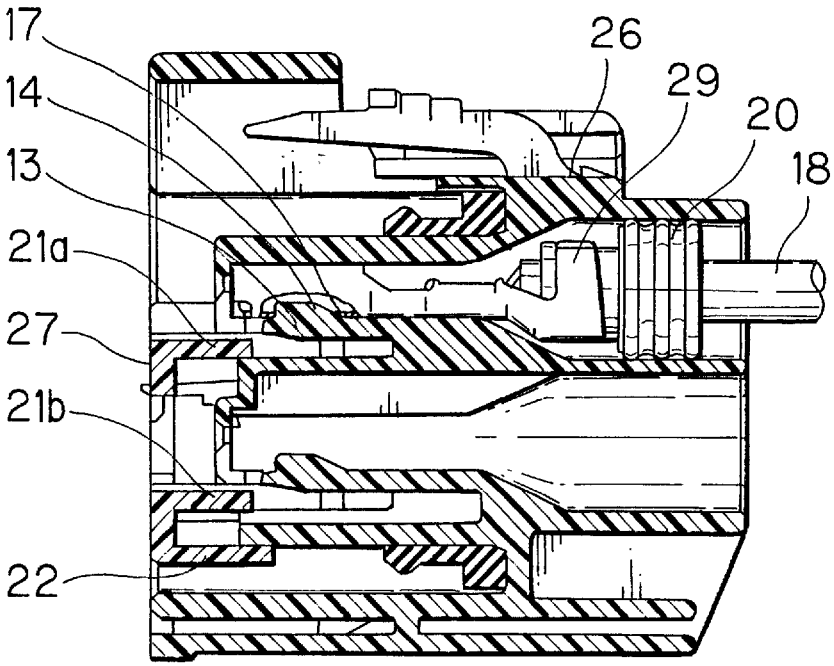
FIG. 13 is a longitudinal sectional view illustrating a fully inserted state of the terminal and the provisional locking position of the front holder.
Figure 14:
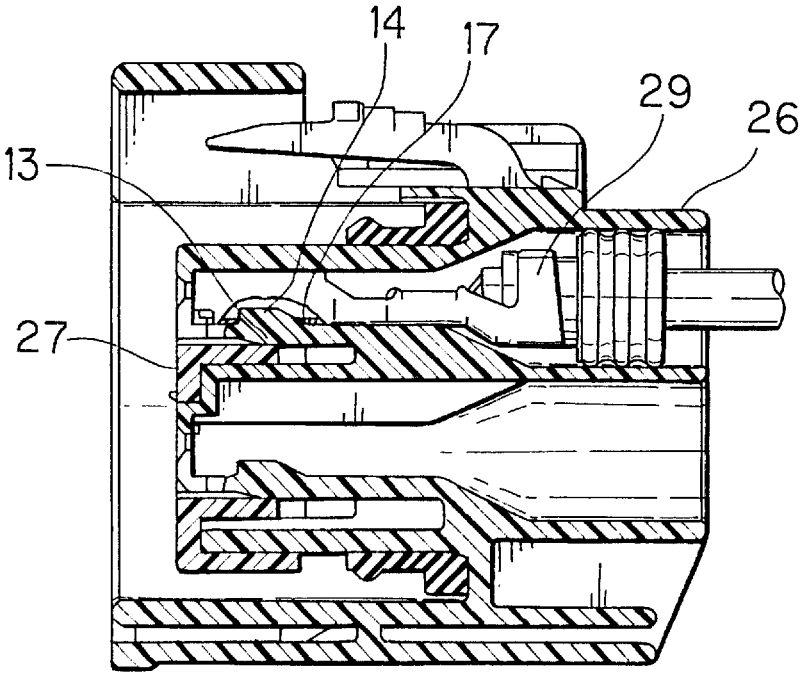
FIG. 14 is a longitudinal sectional view illustrating a state when the front holder is fully inserted in succession from the state shown in FIG. 13.
Figure 15:
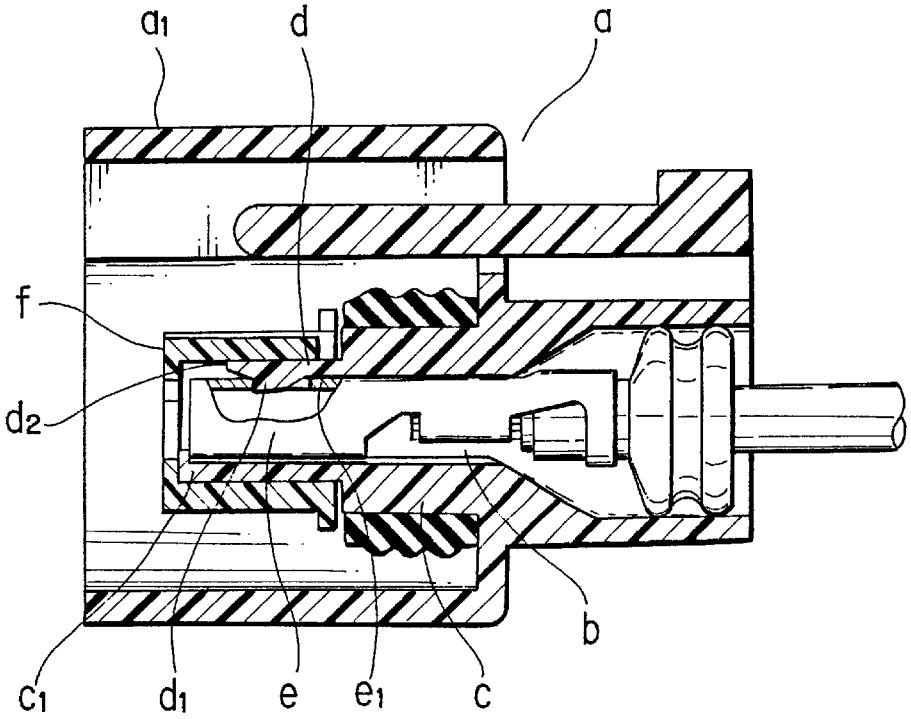
FIG. 15 PRIOR ART
FIG. 15 is a longitudinal sectional view illustrating an example of conventional connector containing front holder.
Figure 16:
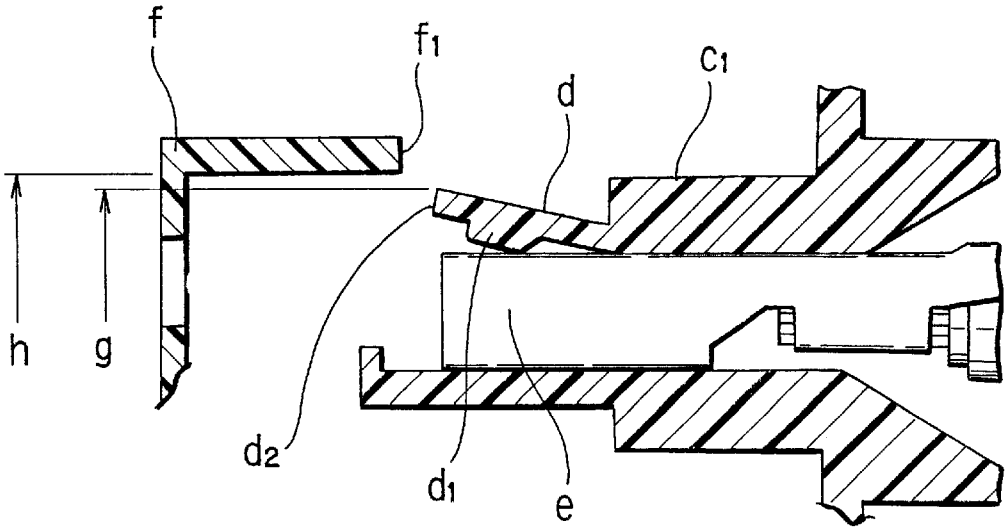
FIG. 16 PRIOR ART
FIG. 16 is a primary part of a longitudinal sectional view of the conventional connector for illustrating a problem encountered therewith.

In FIG. 8, there are shown each perspective view of the male-type connector housing 26, the front holder 27 and a sealing member 28, in FIG. 9, a perspective view from the rear side of the holder 27, and in FIG. 10, a longitudinal sectional view illustrating a state when a female-type terminal 29 and the holder 27 are incompletely inserted into the connector housing 26.

The sealing member 28 seals the contact surface between the end surface of the body 1*a* of the female-type connector housing 1 and the connector housing 26, thereby ensuring the waterproof.

Similar to the first example, in the connector housing 26, there are formed the terminal receiving chamber 5, the notch 12 of which extends from the terminal receiving chamber 5 to the insertion slots 9*a* and 9*b,* and the resilient locking arm 13 having the locking projection 14 and the detection end 15 (see FIG. 10).

A female-type terminal 29, which is received in the chamber 5 to be electrically connected to the male-type terminal 3, has the locking hole 17. Similar to the first example, in the front holder 27, there is provided a holder end 23*a* on the insertion walls 21*a* and 21*b* (see FIG. 8), and the stopper 25 on the resilient wall 24 (see FIGS. 10 and 11).

Now, the function of the above-composed connector housing 26 and the front holder 27 is explained with referring to FIGS. 10 to 14.

As shown in FIG. 10, when the front holder 27 is inserted into the insertion slots 9*a* and 9*b,* the front holder 27 stops at the provisional locking position where the stopper 25 abuts against the stop end 8. In this provisional locking state, the holder end 23*a* of the front holder 27 is located at the position where the surface 23*a* does not hit against the detection end 15 of the locking arm 13.

When the terminal 29 is inserted into the terminal receiving chamber 5, the terminal 29 pushes the locking projection 14 to allow the resilient locking arm 13 to be deformed, causing the detection end 15 to be lowered toward the insertion slot 9*a*.

After the complete insertion of the terminal 29, when the front holder 27 is pushed toward the inserting direction from the provisional locking position, the resilient wall 24 is deformed to allow the stopper 25 to run onto the lower surface of the insertion slot 9*a,* causing the front holder 27 to be lifted up due to the resilient force of the resilient wall 24, that is, the holder end 23*a* of the front holder 27 is significantly lifted up, similar to the first example.

On the other hand, when the terminal 29 is not fully inserted so that the detection end 15 is lowered toward the insertion slot 9*a* (see FIG. 10), the holder end 23*a* inevitably hits the detection end 15 upon the insertion of the front holder 27, resulting in that the incomplete insertion of the terminal 29 is securely detected, even if there are some dimensional errors for the parts related accompanying with the fabrication thereof.

When the terminal 29 is fully inserted, the locking hole 17 of the terminal 29 fits with the locking projection 14 of the resilient locking arm 13, that is, the locking arm 13 resiliently recovers to its original shape (see FIG. 13) from its deformed shape (see FIG. 10). Consequently, the front holder 27 can be fully inserted into the insertion slot 9*a* by pushing from the lifted position as described above (see FIG. 14).

The fully-inserted holder 27 prevents the locking arm 13 from being deformed downward so that the fitting between the locking hole 17 of the terminal 29 and the locking projection 14 of the resilient locking arm 13 is maintained to prevent the terminal 29 from coming off.

What is claimed is:

1. A connector including a connector housing for receiving a terminal containing a locking arm projection-receiving hole and a front holder, said connector housing comprising:

a body portion containing opening means forming at least one terminal-receiving chamber that receives the terminal therein and that forms a stop end at an inner end of said terminal-receiving chamber forming means, insertion guide walls peripherally spaced from, and surrounding, said terminal-receiving chamber-forming means and defining insertion slots between said insertion guide walls and said body portions containing said at least one terminal-receiving chamber, said body portion further including a resilient locking arm having a projection that is engageable by said terminal to resiliently depress said locking aim into an adjacent one of said insertion slots when said projection is engaged by said terminal while inserting said terminal into said terminal-receiving chamber, said locking arm being resiliently raised out of said insertion slot when said projection is received in said locking arm projection-receiving hole when the terminal is fully inserted into the terminal-receiving chamber, a leading end of said resilient locking arm defining a detection end and forming an obstruction in an adjacent insertion slot when the resilient locking arm is depressed thereinto, said front holder being defined by insertion walls that surround said insertion guide walls of said connector housing and that are adapted to be slidingly moved along surfaces on said insertion guide walls to be received into said insertion slots, at least one of said insertion walls on said front holder having a leading end facing the detection end of the resilient locking arm and engaging said detection end thereof to indicate incomplete insertion of said terminal when said locking arm is depressed into an insertion slot containing said at least one insertion wall of said front holder, a resilient wall on said front holder depending from an upper peripheral wall thereof, a stopper formed on said resilient wall in a position longitudinally spaced from said leading end of said upper peripheral wall in a direction parallel to a direction of insertion of said front holder into said insertion space, said stopper being operative to engage said stop end of said body forming said terminal-receiving chamber to stop movement of the front holder into the insertion slot at a provisional locking position whereat the holder end is spaced apart from the detection end of said resilient locking arm, and wherein the stopper is resiliently shifted upward by engagement with the stop end of said body upon movement of the front holder in an inserting direction into said insertion slots to deflect said front holder upwardly, whereby said holder end of said at least one insertion wall of said front holder is assured abutment against the detection end of a resilient locking arm that is depressed into an adjacent insertion slot when a terminal is incompletely inserted into the terminal-receiving chamber, and is movable completely into the insertion slot when the resilient locking arm is raised to place the projection thereon in the projection-receiving hole of the terminal when said terminal is completely inserted into the terminal-receiving chamber.

2. A connector according to claim 1, wherein said stop end of the terminal receiving chamber-forming body portion is disposed at an insertion side of the stopper and said stopper is provided with an inclined stopper face for abutting said stop end and for displacing said front holder with respect to said insertion slots when said front holder is moved into said insertion slots.

* * * * *